United States Patent [19]

Lehmann et al.

[11] Patent Number: 4,465,213

[45] Date of Patent: Aug. 14, 1984

[54] PLEATING MACHINE

[75] Inventors: Clemens M. Lehmann; Erwin E. Feiten; Erich E. zur Nieden, all of Berlin, Fed. Rep. of Germany

[73] Assignee: Karl Rabofsky GmbH, Berlin, Fed. Rep. of Germany

[21] Appl. No.: 450,290

[22] Filed: Dec. 16, 1982

[30] Foreign Application Priority Data

Dec. 22, 1981 [DE] Fed. Rep. of Germany ..... 3151237
Dec. 22, 1981 [DE] Fed. Rep. of Germany ..... 3151239
Dec. 22, 1981 [DE] Fed. Rep. of Germany ..... 3151240

[51] Int. Cl.[3] ..... A41H 43/00
[52] U.S. Cl. ..... 223/30
[58] Field of Search ..... 223/28, 30, 31

[56] References Cited

U.S. PATENT DOCUMENTS 1,710,868 4/1929 Ezbelent et al. ..... 223/30
1,723,688 8/1929 Ezbelent ..... 223/30
1,770,590 7/1930 Ezbelent ..... 223/30
2,923,447 2/1960 Ezbelent ..... 223/30
3,135,443 6/1964 Demagny ..... 223/30

*Primary Examiner*—Louis Rimrodt
*Attorney, Agent, or Firm*—Parmelee, Bollinger & Bramblett

[57] ABSTRACT

In a pleating machine having intermittently driven pleating rolls (4,5), between which a pleatable fabric can be inserted with the aid of pleating blades which are disposed on an upper and a lower blade beam and work in the manner of feed tongs, and in which machine the blade beams are pivotably mounted on arms on a blade shaft (13) which in turn is adapted to be swivelled to-and-fro and optionally to perform axial reciprocating movements, individual drives (17, 18, 19, 20, 21) are provided for driving the individual components participating in the pleating, which drives are associated with the individual components and whose functions are controllable by an electronic control device (22).

25 Claims, 8 Drawing Figures

PLEATING MACHINE

The invention relates to a pleating machine having intermittently driven pleating rolls, between which a pleatable fabric can be introduced with the aid of pleating blades which are disposed on an upper and a lower blade beam and work in the manner of feed tongs, while tipping devices are associated with the blade beams mounted pivotably on the ends of arms on a blade shaft adapted to swivel variable distances to-and-fro.

Pleating machines of the abovedescribed kind are known, with which only a comparatively small number of pleat combinations can be produced. Most of the functions of machines of this kind are controlled mechanically, one or more control shafts being used, these shafts being provided with cams needing to be adjusted in accordance with the kind of pleat pattern desired. The setting-up of the known machine is very laborious and, particularly in cases where only small orders have to be executed, extremely uneconomical.

The problem underlying the invention is that of providing a pleating machine of the generic type described, in which all the functions of the components participating in the pleating are freely selectable with the aid of an electronic program control device.

According to the invention, this problem is solved by providing for driving the pleating rolls, for driving the blade beam, for driving the tipping device for the upper blade beam, and for driving the tipping device for the lower blade beam, individual drives whose functions are controllable independently of one another by means of an electronic control device.

The pleating machine according to the invention provides the advantage that with it a multiplicity of patterns not hitherto achievable can be produced. Mechanical resetting of the machine is no longer required. On the contrary, the work programs can be stored on internal or external data carriers and recalled from case to case.

In pleating machines which are additionally provided with a device for imparting an axial movement into the blade shaft, an additional individual drive controllable by the electronic control device is also used for imparting the axial movement to the blade shaft.

The construction of the device for imparting the axial movement should in this arrangement be clearly visible, and in a simple manner should permit not only a variation of the axial stroke of the blade shaft but also, depending on the kind of pattern desired, a temporary interruption of the axial movements. These requirements are met by a device which has a ball-and-screwthread drive whose threaded spindle is adapted to be driven by an individual drive with a reversible direction of rotation, while its threaded sleeve is connected to the blade shaft.

If the pleating machine is in addition provided with a plurality of pleating blade segments mounted on the blade beams for movement relative to one another, that is to say with a so-called push-up device, individual drives, which are associated with the individual segments and which are also adapted to be controlled by the electronic control device, are also provided for moving the pleating blade segments, and it is then found particularly expedient for the pleating blade segments to be mounted pivotably on the blade beams and for the latter to carry electromagnets, one electromagnet being allocated to each pleating blade segment. Owing to the fact that the electromagnets are mounted on the blade beams together with the pleating blade segments, constructional units are in this case obtained which if required are interchangeable with ordinary types of blade beams.

Further details and features of the invention will be seen from the following description of one example of embodiment, which is illustrated in the accompanying drawing, in which.

Figure 1:
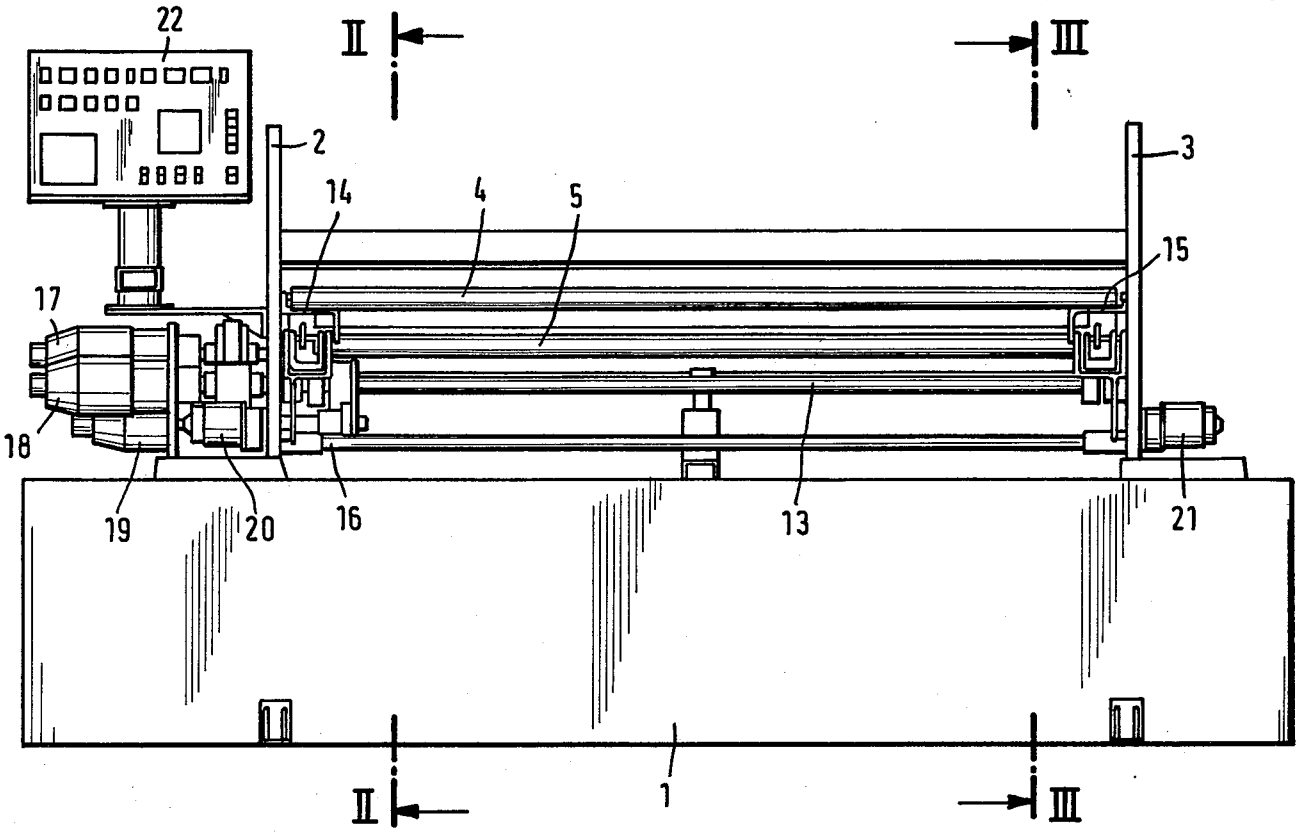
FIG. 1 shows a front view of a pleating machine.
Figure 2:
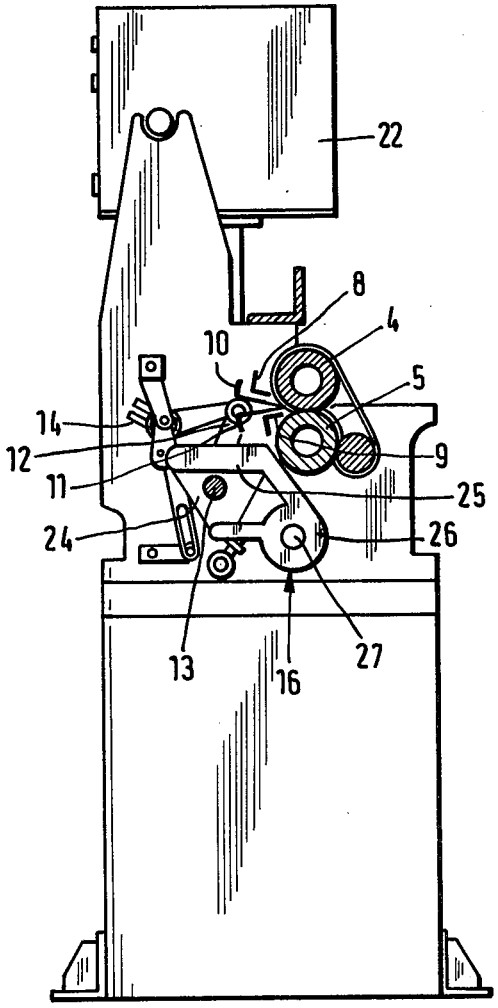
FIG. 2 shows a section along the line II—II in FIG. 1.
Figure 3:
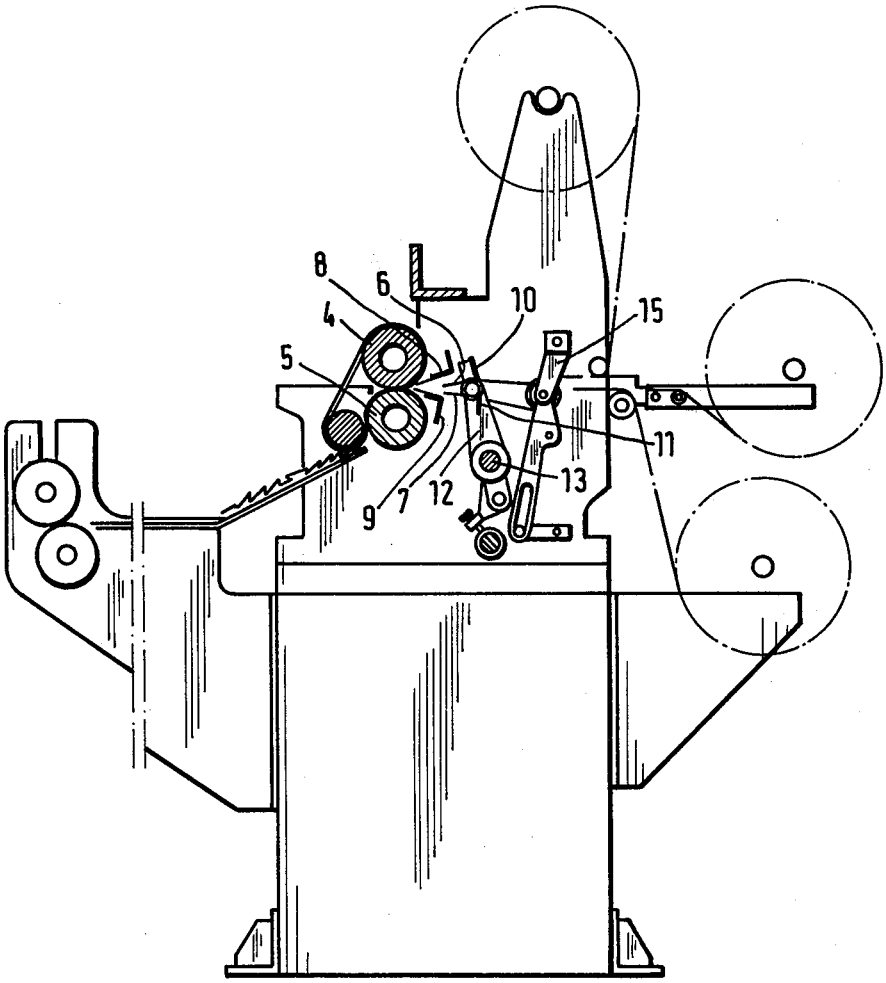
FIG. 3 shows a section along the line III—III in FIG. 1, in which the material feed end and the material delivery end are additionally indicated.

The machine shown has a frame 1 with two side plates 2 and 3. The side plates serve to hold the most important parts of the machine. Between them are in particular mounted two pleating rolls 4 and 5, between which the fabric can be introduced with the aid of pleating blades 6 and 7, the tips of which are guided either along an upper stripper plate 8 or a lower stripper plate 9, depending on the type of pleats to be formed. The pleating blades 6 and 7 are fastened on blade beams 10 and 11, which are pivotably mounted on arms 12 on a blade shaft 13. The blade beams 10 and 11 can perform tipping movements in order to guide the blade tips either along the upper stripper plate 8 or along the lower stripper plate 9, or to open or close the pleating blades in the manner of tongs. In order to impart the tipping movement to the lower blade beam 11, use is made of a tipping device 14 disposed on the left-hand side of the machine, while the tipping of the upper blade beam 10 is effected with the aid of a tipping device 15 disposed on the right-hand side of the machine. An axial movement can be imparted to the knife shaft 13 by means of a screw drive 16.

As can be seen from the figures, the machine is provided with five individual drives 17 to 21 formed by low-inertia electric motors.

The individual drive 17 serves to drive the pleating rolls 4 and 5, the individual drive 18 serves to impart a pivoting movement to the blade shaft 13, the individual drive 19 serves to impart an axial movement to the blade shaft 13, and the individual drives 20 and 21 serve to drive the tipping devices 14 and 15. An electronic control device 22 serves to control the individual drives 17 to 21.

Figure 4:
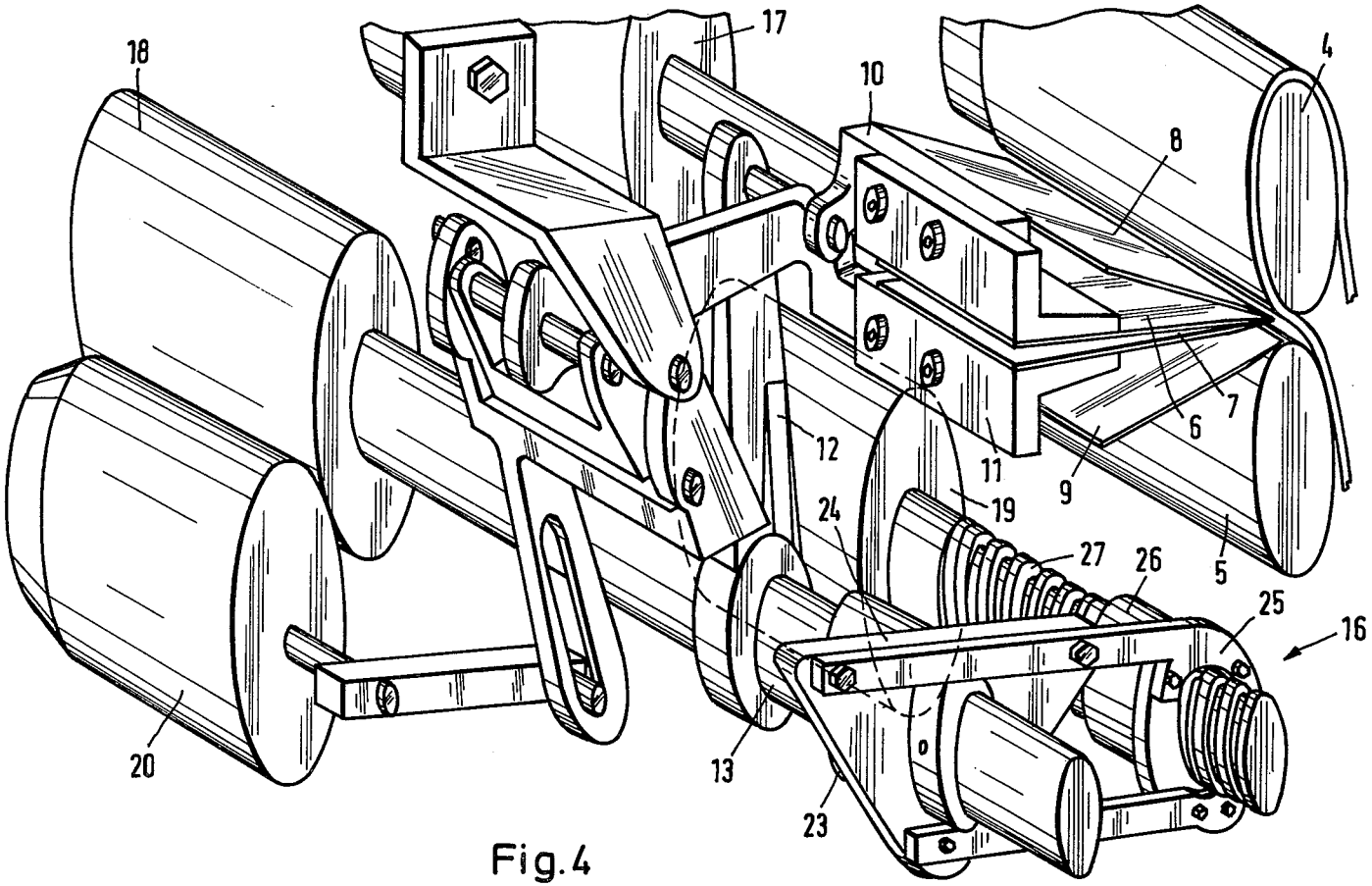
FIG. 4 shows details of a first embodiment of a device for driving the axial movements of the blade shaft in a pleating machine of the kind shown in FIGS. 1 to 3.
Figure 5:
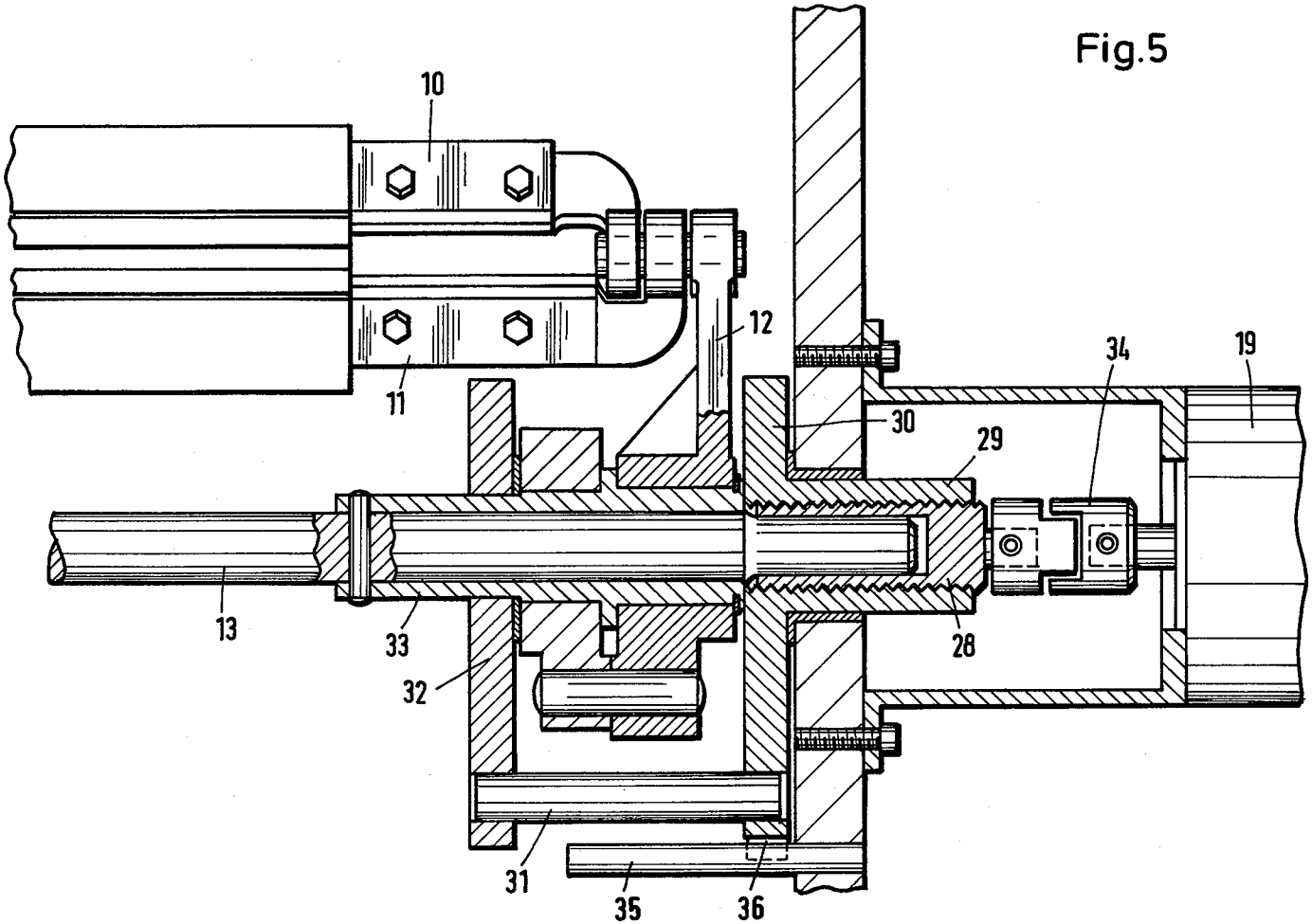
FIG. 5 shows details of a second embodiment of a device for driving the axial movement of the blade shaft in a pleating machine of the kind shown in FIGS. 1 to 3.

Details of the devices for imparting axial movements to the blade shaft 13 can be seen in FIGS. 4 and 5. It can be seen that a bush 23 is mounted on the blade shaft 13, which performs reciprocating movements during the pleating operation, in such a manner as to be rotatable but not axially displaceable relative to the blade shaft 13. This bush 23 carries a plate 24 which is joined via a bridge 25 to the threaded sleeve 26 mounted on the threaded spindle 27 of a ball-and-screwthread drive. The threaded spindle 27 is driven by the individual drive 19, which is preferably formed by a low-inertia disk-rotor motor. The individual drive 19 can perform rotary movements of any desired extent in one direction or the other and at the same time, with the aid of the threaded sleeve 26, the bridge 25, the plate 24 and the bush 23, can impart reciprocating movements to the blade shaft 13 without hindering the swivelling movements of the blade shaft 13.

In FIG. 5, parts corresponding to those shown in FIG. 4 are given the same references as in FIG. 4. In the device shown in FIG. 5 the axes of the threaded spindle 28 and of the blade shaft 13 are in line, and the threaded sleeve 29 is provided with a flange 30, which by means of a pin 31 is fastened to a flange 32 which is mounted for rotation on a tube 33 which carries the arms 12 for the blade beams 10 and 11, which arms are adapted to be swivelled to-and-fro by the blade shaft 13. For the purpose of connecting the individual drive 19 to the threaded spindle 28 use is made of a joint coupling 34, while the threaded sleeve 29 is connected to the blade shaft 13 by means of a fork which is formed by the flanges 30 and 32 and the pin 31 and which permits the swivelling movements of the blade shaft 13 together with the arm 12 and is adapted to move the arm 12, together with the blade shaft 13, to-and-fro in the axial direction. 35 designates a guide pin which prevents rotary movements of the fork and which engages in a slot 36 in the flange 30.

Figure 6:
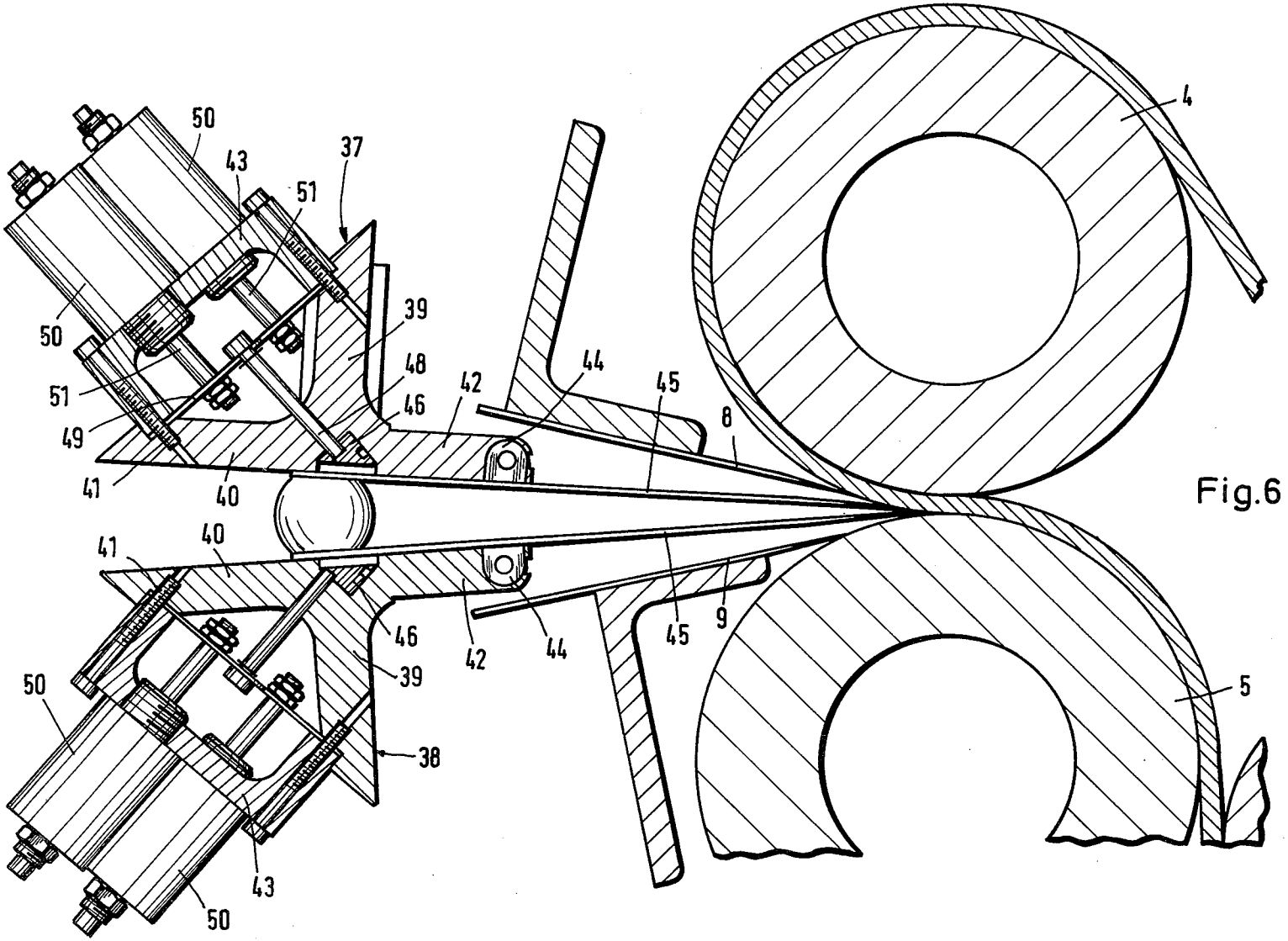
FIG. 6 shows a section through the blade beams, provided with pleating blade segments, and the pleating rolls of a pleating machine.
Figure 7:
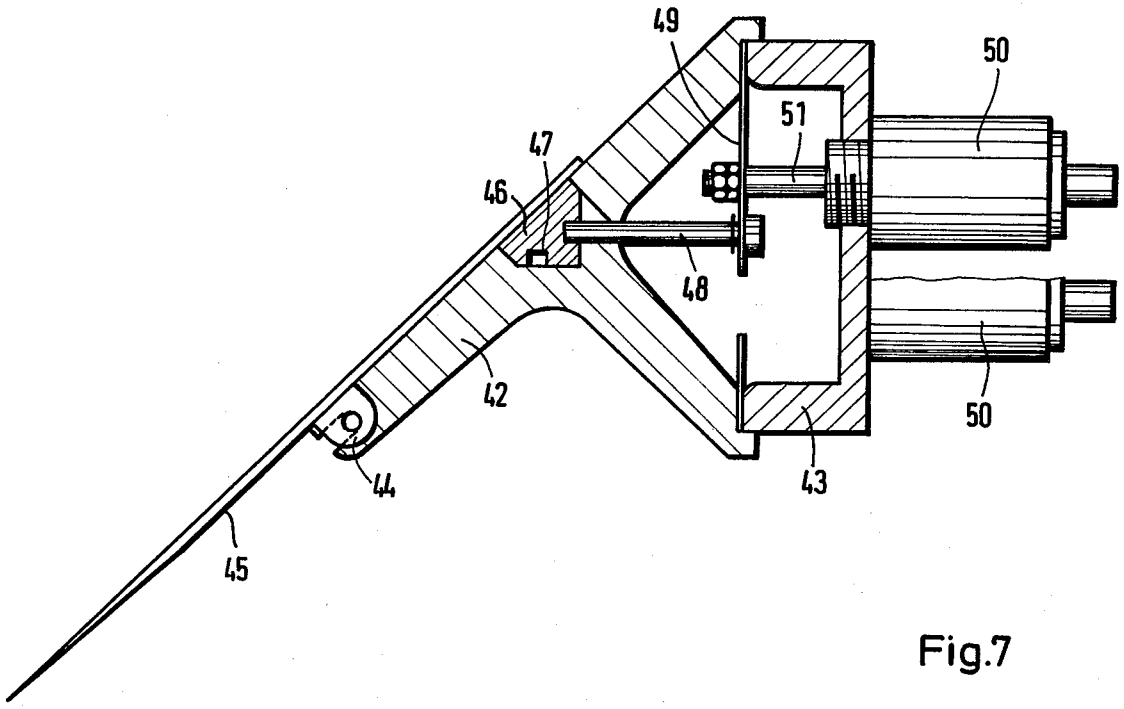
FIG. 7 shows a detail of the device shown in FIG. 6.
Figure 8:
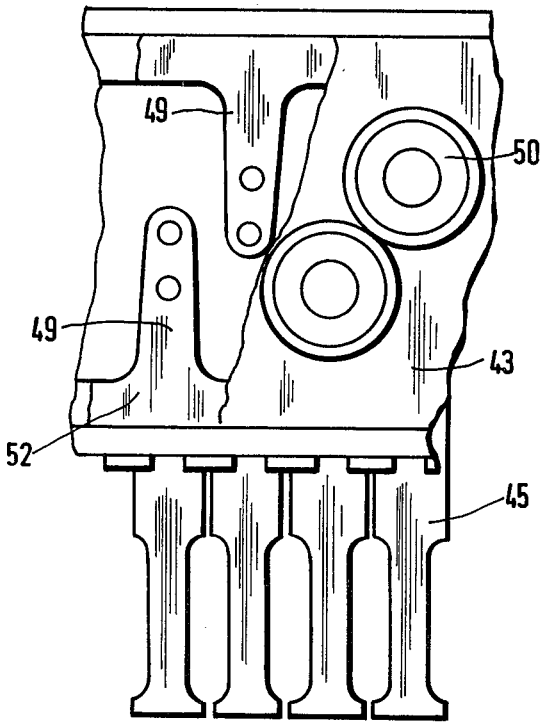
FIG. 8 shows a partial plan view of the device shown in FIGS. 6 and 7.

The electronic control device 22 can also be used for controlling additional individual drives provided, in machines equipped with a so-called push-up device, for operating the individual pleating blade segments of a device of this kind, these individual drives being expediently formed by electromagnets. FIGS. 6 to 8 show how a device of the kind described may be constructed.

In FIG. 6, 37 designates the upper blade beam and 38 the lower blade beam in a pleating machine. The blade beams 37 and 38 have a substantially T-shaped profile, that is to say each of them comprises a longitudinal arm 39 and a cross-arm 40 comprising two portions 41 and 42. In the region of the free ends of the longitudinal arms 39 and of the portion 41 of the cross-arm 40 of the T-section, a bearer 43 formed by a channel section is in each case fastened on the blade beam 37 and 38 respectively. In the region of the free end of the particular other portion 42 of each of the cross-arms 40 of the T-section, pivot bearings 44 for pleating blade segments 45 are disposed. The pleating blade segments 45 are in the form of two-armed levers which at their ends facing the blade beams 37 and 38 respectively carry catch members 46 provided with catch slots 47 for catch pins 48 (see FIG. 7). Individual drives in the form of electromagnets 50, whose armatures 51 act on the springs 49, serve to operate catch pins 48 mounted on springs 49.

As can be seen in FIG. 8, the springs 49 are formed by the tongues of comb-like spring strips 52.

In the operation of the device, a fabric which is to be pleated is guided between the pleating rolls 4 and 5 by the pleating blade segments 45. Depending on the kind of pleats to be formed, the blades are guided along the upper stripper plate 8 or along a lower stripper plate 9. The blade beams 37 and 38 perform a reciprocating movement during this time. At the front dead center of the pleating blade segments 45, near the rolls, the blades are opened, that is to say the upper blade beam 37 is tipped in the direction of the upper stripper plate 8, and the lower blade beam 38 is tipped in the direction of the lower stripper plate 9. The front edge of the upper pleating blade segments is thus pressed against the upper stripper plate 8, and the catch pins 48 engage in the associated catch slots 47 in the catch members 46. The pleating blade segments 45 of the lower blade beam 38 behave similarly. During the return movement of the blade beams, during which the upper pleating blade segments 45 bear against the upper stripper plate 8 and the lower pleating blade segments 45 bear against the lower stripper plate 9, pleating blade segments 45 are unlocked at top and bottom in accordance with the selected program, one unlocked pleating blade segment being associated in each case with a locked pleating blade segment. At the rear dead center of the pleating blade beam movement, the lower blade beam 45 tips in the direction of the upper stripper plate 8, and the bottom pleating blade segments locked to it press against the unlocked top pleating blade segments and the upper stripper plate 8. The pairs of pleating blade semgnets guided in this manner along the upper stripper plate 8 form so-called backward pleats during the forward movement of the blades. Correspondingly, the upper blade beam 37 tips in the direction of the lower stripper plate 9, and the upper pleating blade segments 45 locked to it consequently press against the unlocked bottom pleating blade segments 45 of the lower blade beam. The pairs of pleating blade segments pressed against the lower stripper plate 9 form forward pleats during the forward movement of the blades. By appropriate arrangement of the forward and backward pleats, pleated patterns or designs in a hitherto unknown diversity can be formed.

With a machine of the kind descirbed it is possible to produce automatically pleats of the most varied shape and size in an extremely economical manner. Because of the use of individual drives and because of the selected construction of the machine, the latter can be adpated to the most diverse requirments through the use of the modular construction method.

We claim:

1. A pleating machine having intermittently driven pleating rolls, between which a pleatable fabric can be introduced with the aid of pleating blades which are disposed on an upper and a lower blade beam and work in the manner of feed tongs, while tipping devices are associated with the blade beams mounted pivotably on the ends of arms on a blade shaft adapted to swivel variable distances to-and-fro, wherein for driving the pleating rolls (4, 5), for driving the blade shaft (13), for driving the tipping device (15) for the upper blade beam (10), and for driving the tipping device (14) for the lower blade beam (11), individual drives (17, 18, 20, 21), whose functions are controllable independently of one another by means of an electronic control device (22), are provided.

2. A pleating machine as claimed in claim 1, which has a device for imparting an axial movement to the blade shaft, wherein even for the purpose of imparting the axial movement to the blade shaft (13) use is made of an individual drive (19) which is controllable by the electronic control device and whose direction of rotation is reversible.

3. A pleating machine as claimed in claim 2, wherein the individual drive (19) for the reciprocating movement of the blade shaft (13) drives the threaded spindle (27; 28) of a ball-and-screwthread drive whose threaded sleeve (26; 29) is connected to the blade shaft (13).

4. A pleating machine as claimed in claim 3, wherein the individual drive (19) is connected via a gear unit to the threaded spindle (27; 28) of the ball-and-screwthread drive.

5. A pleating machine as claimed in claim 3 or 4, wherein the threaded spindle (27) extends parallel to the blade shaft (13), and the threaded sleeve (26) is joined via a bridge (25) to a bush (23) which in the axial direction is immovably fixed on the blade shaft (13) but in the direction of rotation of the blade shaft (13) is pivotably mounted on the latter.

6. A pleating machine as claimed in claim 3 or 4, wherein the axes of the threaded spindle (28) and of the blade shaft (13) are in line with one another, and the threaded sleeve (29) is connected to the blade shaft (13) by components (30, 31, 32, 33) adapted to impart an axial movement of the blade shaft (13).

7. A pleating machine as claimed in claim 6, wherein a fork is used to transmit the axial movement of the threaded sleeve (29) to the blade shaft (13).

8. A pleating machine as claimed in either of claims 1 or 2, which has a plurality of pleating blade segments mounted on the blade beams for movement relative to one another, wherein for the movement of the pleating blade segments (45) use is made of individual drives which are allocated to the individual segments and which are controllable by the electronic control device.

9. A pleating machine as claimed in claim 8, wherein the individual drives for moving the pleating blade segments are formed by electromagnets (50).

10. A pleating machine as claimed in claim 9, wherein the pleating blade segments (45) are pivotably mounted on the blade beams (37, 38) and the blade beams (37, 38) carry the electromagnets (50), one electromagnet (50) being associated with each pleating blade segment (45).

11. A pleating machine as claimed in claim 10, wherein the pleating blade segments (45) are in the form of two-armed levers which carry catch members (46) at their ends facing the blade beam (37, 38).

12. A pleating machine as claimed in claim 11, wherein the catch members (46) are provided with catch slots (47) for catch pins (48) adapted to be moved to-and-fro by the electromagnets (50).

13. A pleating machine as claimed in claim 12, wherein the catch pins (48) are mounted on springs (49) which hold them in their engaged positions, from which they can be released by the electromagnets (50).

14. A pleating machine as claimed in claim 13, wherein the springs (49) are formed by tongues of comb-like spring strips (52).

15. A pleating machine as claimed in claim 10, wherein the blade beams (37,38) have a substantially T-shaped profile.

16. A pleating machine as claimed in claim 15, wherein a bearer (43) for the electromagnets (50) is fastened in the region of the free ends of the longitudinal arm (39) and of one portion (41) of the cross-arm (40) of the T-section.

17. A pleating machine as claimed in claim 16, wherein the bearer (43) is formed by a channel section.

18. A pleating machine as claimed in claim 16, wherein pivot bearings (44), in the form of slots, for pivot pins of the pleating blade segments (45) are disposed in the region of the free end of the other portion (42) of the cross-arm (40) of the T-section.

19. A pleating machine as claimed in claim 16, wherein holders for catch members (46) joined to the pleating blade segments (45) are disposed in the region of the center of the cross-arm (40) of the T-section.

20. A pleating machine as claimed in claim 10, wherein the electromagnets (50) associated with the pleating blade segments (45) are mounted in a staggered formation in two rows on the respective blade beam (37,38).

21. A pleating machine as claimed in claim 10, wherein the electromagnets (50) associated respectively with the pleating blade segments (45) of each pair of pleating blade segments assume opposite switch positions.

22. A pleating machine as claimed in claim 1 or 2, wherein the individual drives (17, 18, 19, 20, 21) are formed by a low-inertia electric motor.

23. A pleating machine as claimed in claim 22, wherein the electric motor is formed by a direct current motor.

24. A pleating machine as claimed in claim 22, wherein the electric motor is in the form of a disk-rotor motor.

25. A pleating machine as claimed in claim 22, wherein the speed of rotation of the individual drives (17, 18, 19, 20, 21) is variable.

* * * * *